US008081888B2

(12) United States Patent
Okano

(10) Patent No.: US 8,081,888 B2
(45) Date of Patent: Dec. 20, 2011

(54) ESTIMATING AMOUNT OF TONER IN AN IMAGE FORMING DEVICE

(75) Inventor: Tetsuya Okano, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 907 days.

(21) Appl. No.: 12/076,695

(22) Filed: Mar. 21, 2008

(65) Prior Publication Data

US 2008/0292332 A1 Nov. 27, 2008

(30) Foreign Application Priority Data

May 24, 2007 (JP) ..... 2007-138048

(51) Int. Cl.
*G03G 15/08* (2006.01)

(52) U.S. Cl. ..... 399/27

(58) Field of Classification Search ..... 399/27, 399/28, 29, 30, 61
See application file for complete search history.

(56) References Cited

U.S. PATENT DOCUMENTS

| | | | | |
|---|---|---|---|---|
| 6,337,956 | B1 | 1/2002 | Sato et al. | |
| 6,829,443 | B2 * | 12/2004 | Byun et al. | 399/12 |
| 2006/0263106 | A1 * | 11/2006 | Yamaguchi et al. | 399/27 |
| 2008/0219686 | A1 * | 9/2008 | Yamagata | 399/53 |

FOREIGN PATENT DOCUMENTS

| | | | |
|---|---|---|---|
| JP | 2000-250301 | | 9/2000 |
| JP | 2001-147579 | A | 5/2001 |
| JP | 2001-222141 | | 8/2001 |
| JP | 2001-290357 | A | 10/2001 |
| JP | 2002-214899 | | 7/2002 |
| JP | 2002-244424 | A | 8/2002 |
| JP | 2003-91218 | | 3/2003 |
| JP | 2004-118218 | A | 4/2004 |
| JP | 2005-134794 | | 5/2005 |
| JP | 2007-79336 | A | 3/2007 |

OTHER PUBLICATIONS

JP Office Action dtd Oct. 20, 2009, JP App. 2007-138048.

* cited by examiner

*Primary Examiner* — David Gray
*Assistant Examiner* — Billy J Lactaoen
(74) *Attorney, Agent, or Firm* — Banner & Witcoff, Ltd.

(57) ABSTRACT

An image forming device includes a container accommodating toner, a light emitting unit emitting light to be transmitted through the container, a light receiving unit receiving the light transmitted through the container, an efficiency determining unit determining a light receiving efficiency based on a light intensity of the light received by the light receiving unit, an execution amount determining unit determining an execution amount of image forming operations that represents an accumulated amount of image forming operations executed since first use of the container, a correction coefficient determining unit determining a correction coefficient based on the execution amount of image forming operations, an efficiency modifying unit modifying the light receiving efficiency with the correction coefficient, and an estimating unit estimating an amount of the toner remaining in the container based on the modified light receiving efficiency.

9 Claims, 5 Drawing Sheets

ESTIMATING AMOUNT OF TONER IN AN IMAGE FORMING DEVICE

CROSS-REFERENCE TO RELATED APPLICATION

This application claims priority under 35 U.S.C. §119 from Japanese Patent Application No. 2007-138048 filed on May 24, 2007. The entire subject matter of the application is incorporated herein by reference.

BACKGROUND

1. Technical Field

The following description relates to one or more techniques to estimate a remaining toner amount in an image forming device.

2. Related Art

A conventional image forming device is disclosed in Japanese Patent Provisional Publication No. 2000-250301. The image forming device is configured to transfer and fix toner onto a paper based on image forming data and form an image on the paper. The image forming device is provided with a container accommodating the toner and agitating unit for agitating the toner in the container. Further, the image forming device includes a light emitting unit configured to emit light to be transmitted through the container, light receiving unit configured to receive the light emitted by the light emitting unit, and estimating unit configured to estimate the amount of the toner left in the container based on a light receiving efficiency determined from the light intensity of the light received by the light receiving unit.

In the conventional image forming device configured as above, the toner in the container is gradually consumed and reduced by image forming operations. The more the toner is consumed, the more easily the light emitted by the light emitting unit can reach the light receiving unit. Therefore, the light receiving efficiency is increased as the toner is more consumed. For this reason, the estimating unit can estimate the amount of the toner remaining in the container by comparing the light receiving efficiency with a predetermined threshold.

SUMMARY

However, according to the above conventional image forming device, when the toner in the container is agitated by the agitating unit, the distribution of the toner in the container is drastically changed and/or part of the toner is temporarily floated, since the toner is constituted by fine particles with a high fluidity. Hence, as the light receiving efficiency varies along with the agitating operation, it is difficult to improve the accuracy for estimating the remaining toner with the conventional technique in which the amount of the toner left in the container is estimated merely based on the light receiving efficiency. Thus, for example, there might be caused improper judgment that there is a small amount of toner left in the container even though the image forming operation is hardly performed after an old container has been replaced with the present one.

Aspects of the present invention are advantageous in that there can be provided one or more improved image forming devices, and methods and computer readable media therefor that can estimate an amount of toner remaining in a container with high accuracy.

According to aspects of the present invention, there is provided an image forming device, which includes a container configured to accommodate toner, a light emitting unit configured to emit light to be transmitted through the container, a light receiving unit configured to receive the light transmitted through the container, an efficiency determining unit configured to determine a light receiving efficiency based on a light intensity of the light received by the light receiving unit, an execution amount determining unit configured to determine an execution amount of image forming operations that represents an accumulated amount of image forming operations executed since first use of the container, a correction coefficient determining unit configured to determine a correction coefficient based on the execution amount of image forming operations determined by the execution amount determining unit, an efficiency modifying unit configured to modify the light receiving efficiency determined by the efficiency determining unit with the correction coefficient determined by the correction coefficient determining unit, and an estimating unit configured to estimate an amount of the toner remaining in the container based on the light receiving efficiency modified by the efficiency modifying unit.

In some aspects, the image forming device can modify the light receiving efficiency with the correction coefficient which varies depending on the execution amount of image forming operations. Then the image forming device can estimate the amount of the toner remaining in the container based on the modified light receiving efficiency. Therefore, the image forming device can appropriate modify the light receiving efficiency to estimate the remaining toner amount, even though the light receiving efficiency fluctuates, for example, along with the toner in the container being agitated by the agitating unit.

Thus, the image forming device according to aspects of the present invention can estimate the amount of the toner remaining in the container with higher accuracy. Consequently, there would be less likely to be caused improper judgment that there is a small amount of toner left in the container even though the image forming operation is hardly performed after an old container has been replaced with the present one.

According to another aspect of the present invention, there is provided a method applicable to an image forming device configured to estimate an amount of toner remaining in a container thereof with an efficiency of light transmitted through the container, which method includes a first step of determining the efficiency based on a light intensity of the light transmitted through the container, a second step of determining an execution amount of image forming operations that represents an accumulated amount of image forming operations executed since first use of the container, a third step of determining a correction coefficient based on the execution amount of image forming operations determined in the second step, a fourth step of modifying the efficiency determined in the first step with the correction coefficient determined in the third step, and a fifth step of estimating the amount of the toner remaining in the container based on the efficiency modified in the fourth step.

With the method configured as above, the same effects as the aforementioned image forming device can be provided.

According to a further aspect of the present invention, there is provided a computer readable medium having computer readable instructions stored thereon, which cause a computer capable of image forming operations, configured to estimate an amount of toner remaining in a container thereof with an efficiency of light transmitted through the container, to perform a first step of determining the efficiency based on a light intensity of the light transmitted through the container, a second step of determining an execution amount of image forming operations that represents an accumulated amount of image forming operations executed since first use of the container, a third step of determining a correction coefficient based on the execution amount of image forming operations determined in the second step, a fourth step of modifying the efficiency determined in the first step with the correction coefficient determined in the third step, and a fifth step of estimating the amount of the toner remaining in the container based on the efficiency modified in the fourth step.

With the computer readable medium configured as above, the same effects as the aforementioned image forming device can be provided.

BRIEF DESCRIPTION OF THE ACCOMPANYING DRAWINGS

Figure 5:
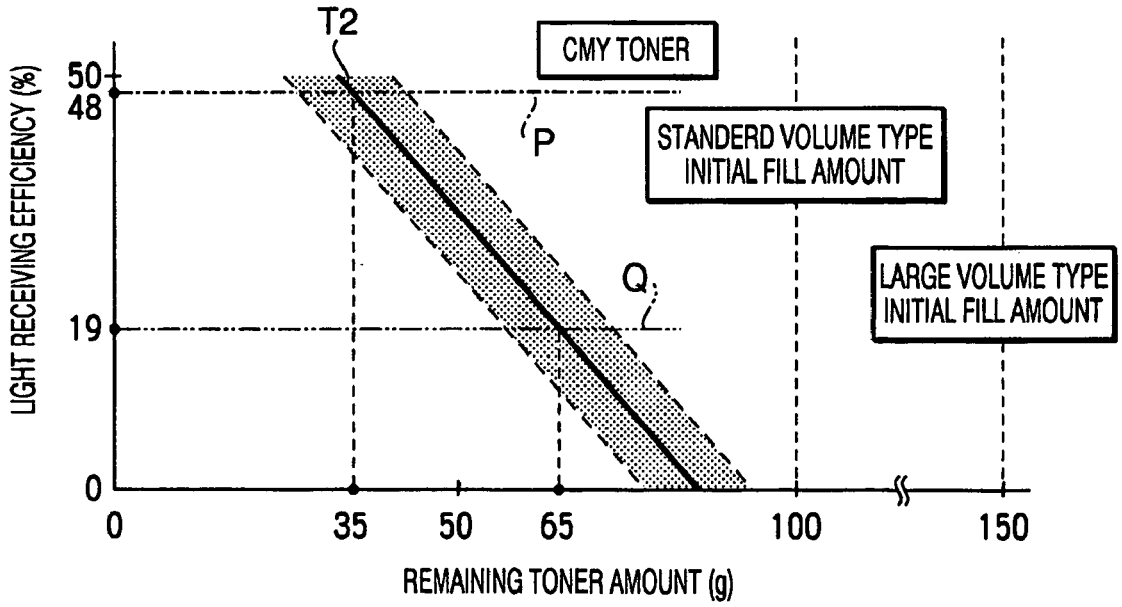

FIG. 5 schematically shows relationship between a remaining toner amount in a container for CMY toner and the light receiving efficiency (%) in the embodiment according to one or more aspects of the present invention.

Figure 6:
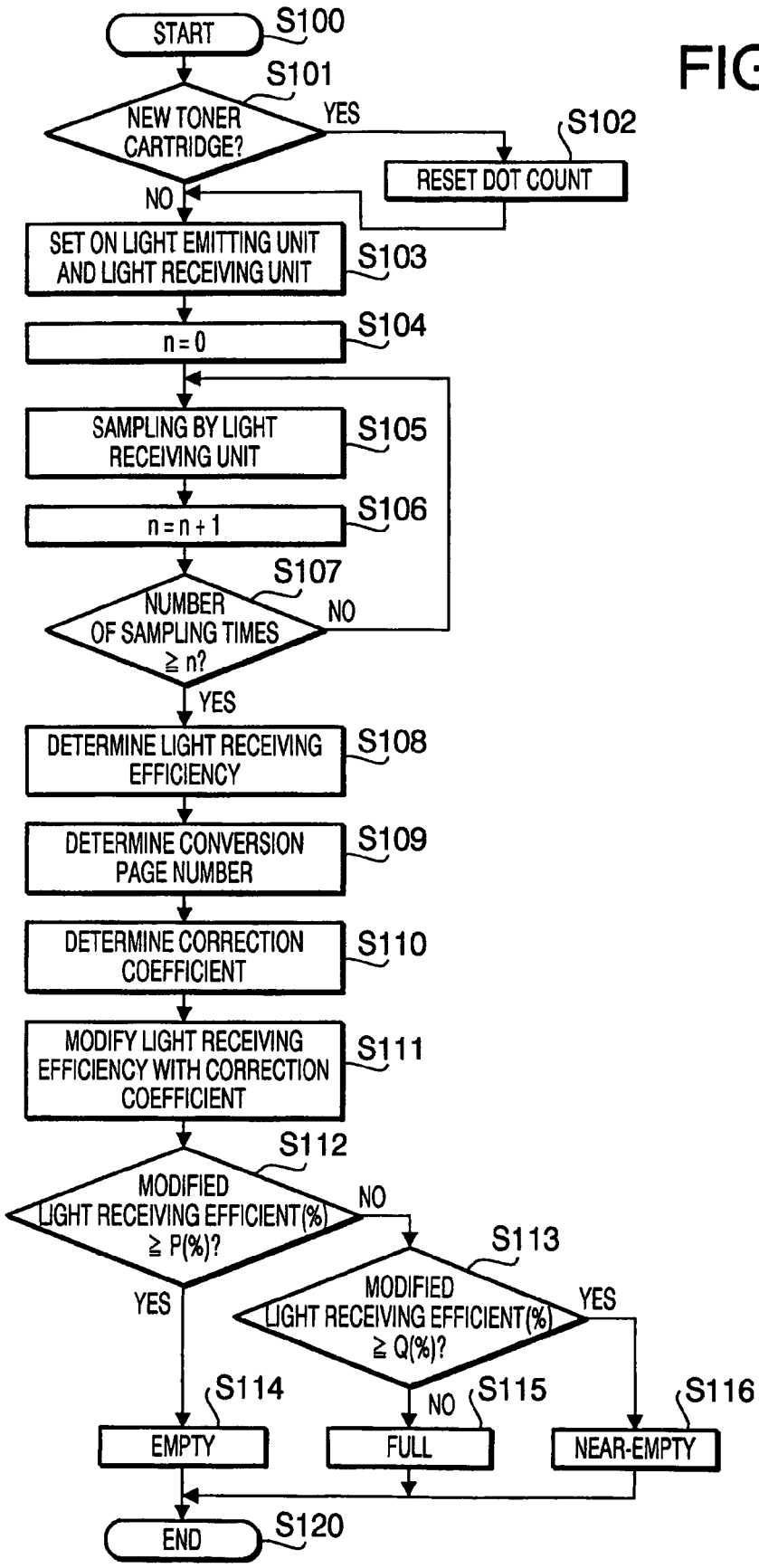

FIG. 6 is a flowchart showing a remaining toner amount estimating process in the embodiment according to one or more aspects of the present invention.

Figure 7:
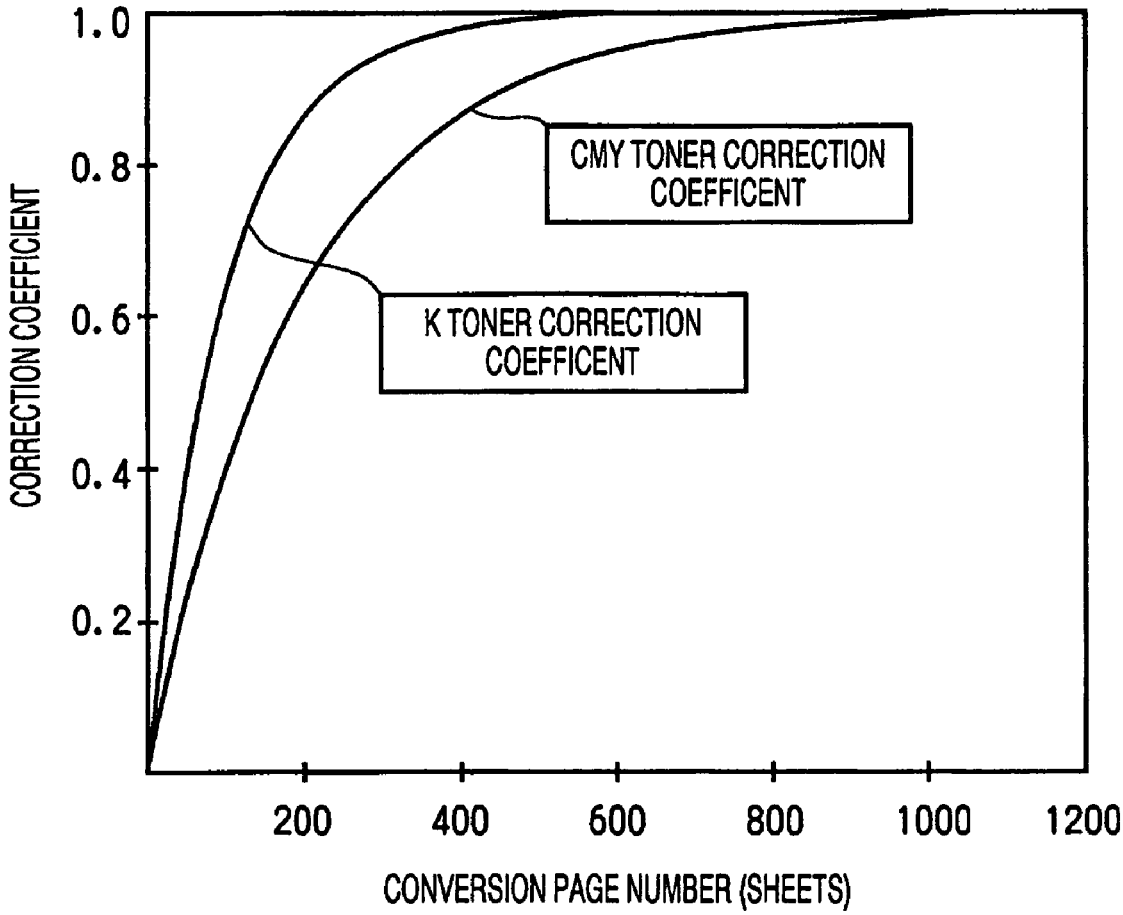

FIG. 7 schematically shows relationship between a conversion page number and a correction coefficient for each of the K toner and CMY toner in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

Hereinafter, an embodiment according to aspects of the invention will be described with reference to the accompanying drawings.

Figure 1:
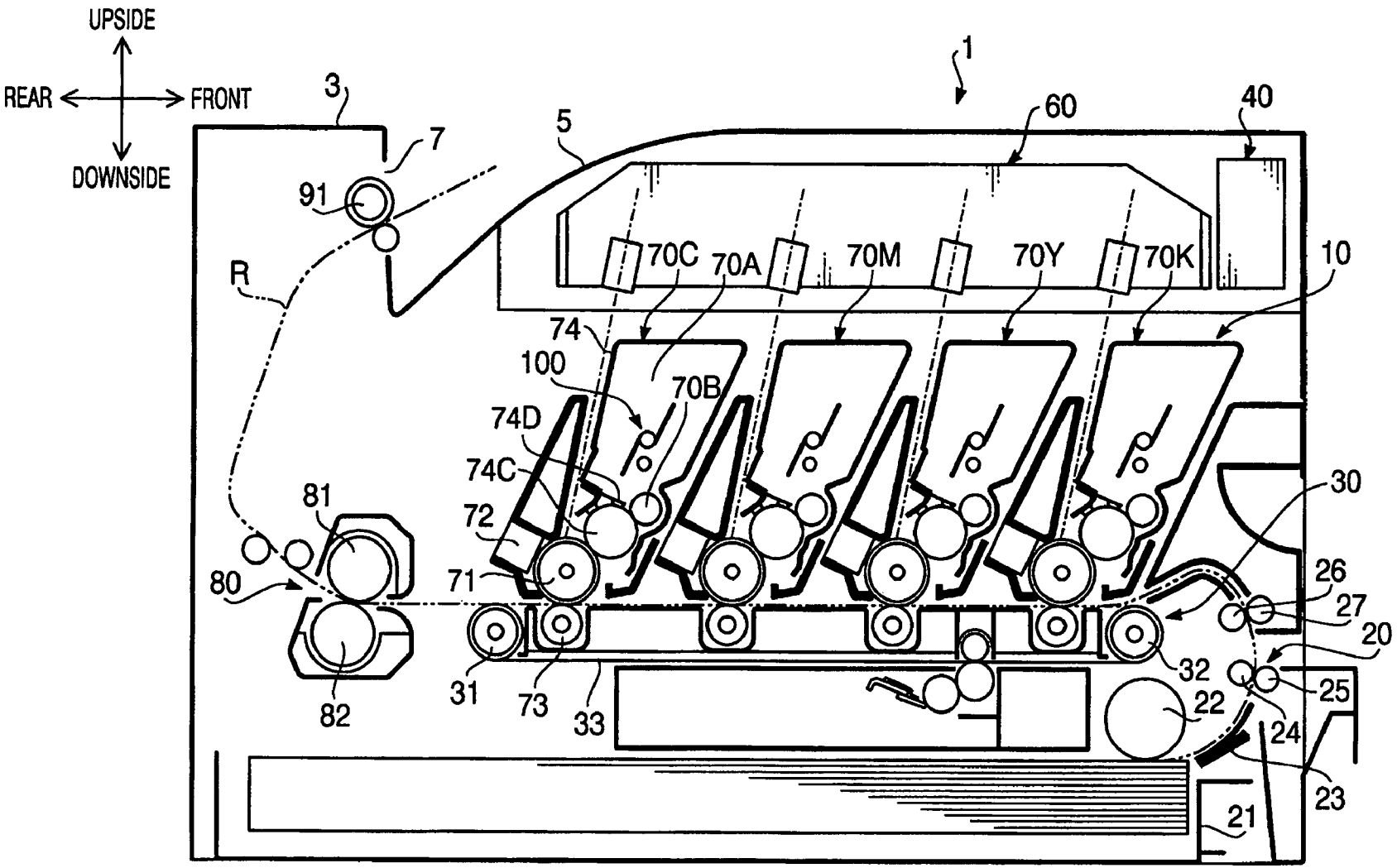
FIG. 1 is a cross-sectional view of an image forming device in an embodiment according to one or more aspects of the present invention.

FIG. 1 schematically shows a cross-sectional view of an image forming device in an embodiment according to aspects of the present invention. As shown in FIG. 1, a laser printer 1 as the image forming device of the present embodiment is configured to transfer toner onto a paper with an electrophotographic technology. The laser printer 1 is installed with an upper side of FIG. 1 directed upward along a gravitational force direction, and generally used with a right side of the figure as a front side thereof.

The laser printer 1 is provided with a feeder portion 20, carrying mechanism 30, image forming unit 10, and control unit 40 in a substantially box-shaped (rectangular parallelepiped) housing 3. Further, the laser printer 1 includes a catch tray 5 on which a paper ejected from the housing 3 after an image forming operation, at an upper surface side of the housing 3. Hereinafter, details of each component of the laser printer 1 will be given.

1. Control Unit

As shown in FIG. 1, the control unit 40 is configured to control the feeder portion 20, carrying mechanism 30, and image forming unit 10 to form an image on the basis of image formation data transmitted by an external electronic computer. In addition, the control unit 40 includes a below-mentioned remaining toner estimating process (flowchart shown in FIG. 6) to estimate an amount of toner left in a container 74A of the image forming unit 10 (hereinafter, simply referred to as a "toner remaining amount").

2. Feeder Portion

As shown in FIG. 1, the feeder portion 20 is provided with a paper feed tray 21 provided at the lowest part of the housing 3, paper feed roller 22 provided at an upper portion of a front end of the paper feed tray 21 to carry a paper placed in the paper feed tray 21 to the image forming unit 10, and a separation pad 23 that separates papers fed by the paper feed roller 22 on a sheet-by-sheet basis by applying a predetermined carrying resistance to the papers.

Further, there are provided at a substantially U-shaped turnaround portion in a front of a paper carrying route R, carrying rollers 24 and 25 which apply a carrying force to a paper to be carried to the image forming unit 10 so as to be bent in a substantially U-shaped.

In addition, there are provided at a more downstream side of the paper carrying route R than the carrying rollers 24 and 25, registration rollers 26 and 27 that correct the direction of the paper which might obliquely be carried by the carrying rollers 24 and 25 by contacting a leading edge of the paper and thereafter further carry the paper toward the image forming unit 10.

3. Carrying Mechanism

The carrying mechanism 30 is configured with a carrying belt 33 provided between the image forming unit 10 at an upper side and the paper feed tray 21 at a lower side, discharge chute (not shown), and discharge roller 91.

The carrying belt 33 is configured to be rotatably wound around a driving roller 31 which rotates in conjunction with the image forming unit 10 and a driven roller 32 rotatably provided away from the driving roller 31.

The carrying mechanism 30 configured as above carries the paper conveyed from the feeder portion 20 to the image forming unit 10 along the paper carrying route R when the carrying belt 33 is rotated with the paper placed thereon. Then, the paper with an image formed thereon is discharged from a discharge portion 7 to the catch tray 5 by the discharge chute and discharge roller 91.

4. Image Forming Unit

As shown in FIG. 1, the image forming unit 10 is configured with a scanner unit 60, four process cartridges 70C, 70M, 70Y, and 70K, and a fixing unit 80.

4.1. Scanner Unit

The scanner unit 60, which is provided at an upper portion in the housing 3, is configured with a laser light source, a polygon mirror, fθ lenses, and reflecting mirrors.

A laser beam emitted by the laser light source is deflected by the polygon mirror. Then, the laser beam is transmitted through the fθ lenses, and thereafter the light path thereof is bent by a reflecting mirror. Further, the light path of the laser beam is bent downward by another reflecting mirror. Thereby, the laser beam is incident onto a photoconductive drum 71 provided in each of the four process partridges 70C, 70M, 70Y, and 70K to form an electrostatic latent image on the photoconductive drum 71.

4.2. Process Cartridge

The process cartridge 70C is provided for cyan-colored toner (hereinafter, simply referred to as a "C toner"). The process cartridge 70M is provided for magenta-colored toner (hereinafter, simply referred to as an "M toner"). The process cartridge 70Y is provided for yellow-colored toner (hereinafter, simply referred to as a "Y toner"). The process cartridge 70K is provided for black-colored toner (hereinafter, simply referred to as a "K toner"). Furthermore, the C toner, M toner, and Y toner are collectively referred to simply as "CMY toner."

The process cartridges 70C, 70M, 70Y, and 70K are different only in the color of the toner thereof, and the other factors such as structures thereof are the same. Hence, hereinafter, the structures thereof will be described with the process cartridge 70C as an example.

As shown in FIG. 1, the process cartridge 70C is configured with the widely-known photoconductive drum, an electrification control device 72, and a toner cartridge 74.

In addition, a transfer roller 73 is rotatably provided at a side opposite the photoconductive drum 71 with respect to the carrying belt 33. The transfer roller 73 is configured to transfer the toner adhering to a surface of the photoconductive drum 71 onto the paper when the paper passes by the photoconductive drum 71.

The toner cartridge 74 is configured with the container 74A accommodating the toner, a supply roller 74B configured to supply the toner to a developing roller 74C, and the developing roller 74C. The toner in the container 74A is supplied to the developing roller 74C by the rotation of the supply roller 74B. Further, the toner supplied to the developing roller 74C is held on a surface of the developing roller 74C. Then, the toner held is adjusted by a layer thickness control blade 74D to have a predetermined even thickness, and thereafter, supplied to the surface of the photoconductive drum 71.

In addition, the toner cartridge 74 is detachably attached to a frame member (not shown) provided to the housing 3 as an independent unit. Further, when the toner left in the container 74A is consumed to be less than a predetermined value, the toner cartridge 74 is removed from the housing 3, and replaced with a new one. At this time, when a toner cartridge 74 is attached, it is judged by a widely-known detector (not shown) whether the attached cartridge 74 is new, and the judgment result is transmitted to the control unit 40, the judgment result is used for a step S101 of the below-mentioned remaining toner estimating process.

4.3. Fixing Unit

The fixing unit 80 is provided at the more downstream side of the paper carrying route R than the photoconductive drum 71. The fixing roller 80 is configured with a widely-known heating roller 81 and pressing roller 82, to heat, melt, and fix therewith the toner transferred onto the paper.

4.4. Overview of Image Forming Operation

The laser printer configured as above of the present embodiment forms an image on the paper as follows. When an image forming operation is started, the control unit 40 controls the feeder portion 20 and carrying mechanism 30 to convey the paper to the image forming unit 10. The control unit 40 concurrently controls the scanner unit 60, process cartridges 70C, 70M, 70Y, and 70K of the image forming unit 10 based on the image formation data. Therefore, the surface of the photoconductive drum 71 is evenly and positively charged by the electrification control device 72 along with the rotation of the photoconductive drum 71, and thereafter exposed by the laser beam emitted by the scanner unit 60, so that an electrostatic latent image can be formed thereon in accordance with the image formation data.

Subsequently, when the developing roller 74C faces and contacts the photoconductive drum 74C, the positively-charged toner held on the developing roller 74C is supplied to the electrostatic latent image formed on the surface of the photoconductive drum 71 along with the rotation of the developing roller 74C. Thereby, the electrostatic latent image on the photoconductive drum 71 becomes a visually-recognized image, which is an inversed image of the toner held on the surface of the photoconductive drum 71.

Thereafter, the toner image held on the surface of the photoconductive drum 71 is transferred onto the paper by a transfer bias voltage applied to the transfer roller 73. Then, the paper with the toner image transferred thereon is conveyed to the fixing unit 80, and heated and pressed by the fixing roller 81 and pressing roller 82 so that the toner transferred as the toner image can be fixed on the paper. Finally, the paper with the image formed thereon is discharged to the catch tray 5, and the image forming operation is ended.

The laser printer 1 operating as above in the present embodiment is provided with an agitating unit 100, light emitting unit 110, and light receiving unit 120 for each of the four containers 74A of the process cartridges 70C, 70M, 70Y, and 70K. The laser printer 1 can estimate an amount of the toner left in each of the four containers 74A in the remaining toner estimating process (flowchart shown in FIG. 6) to be executed by the control unit 40. It is noted that agitating units 100, light emitting units 110, and light receiving units 120 are configured in the same manner among the process cartridges 70C, 70M, 70Y, and 70K. Therefore, only explanation of the process cartridge 70C will be given hereinafter.

5. Agitating Unit

Figure 2:
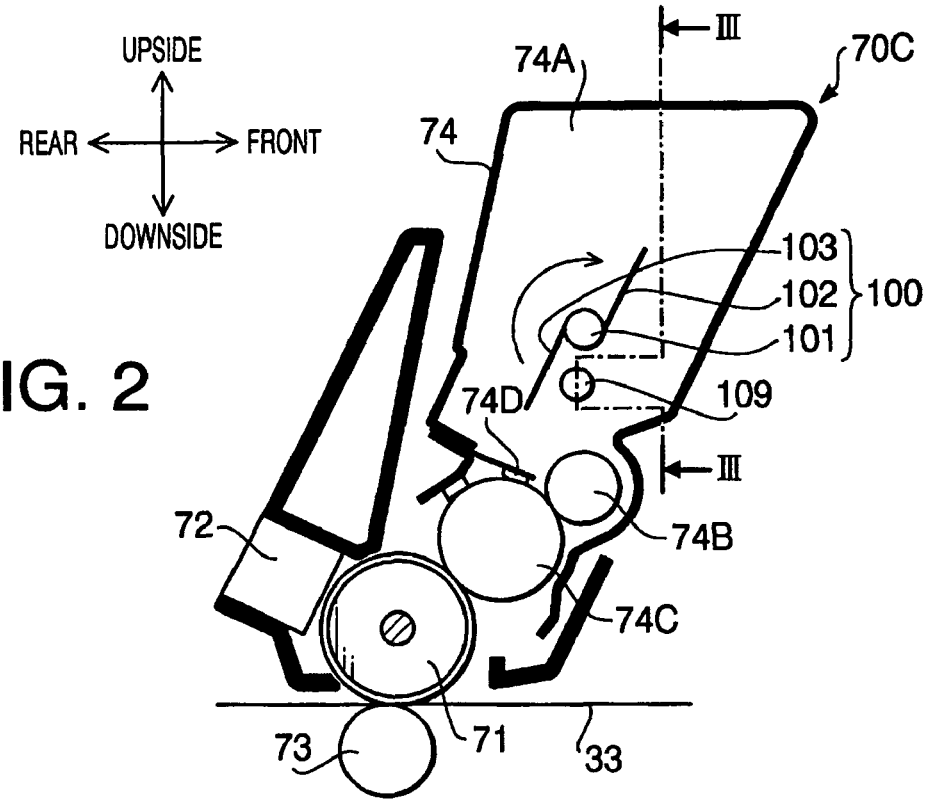
FIG. 2 is a cross-sectional view of a process cartridge of the image forming device in the embodiment according to one or more aspects of the present invention.
Figure 3:
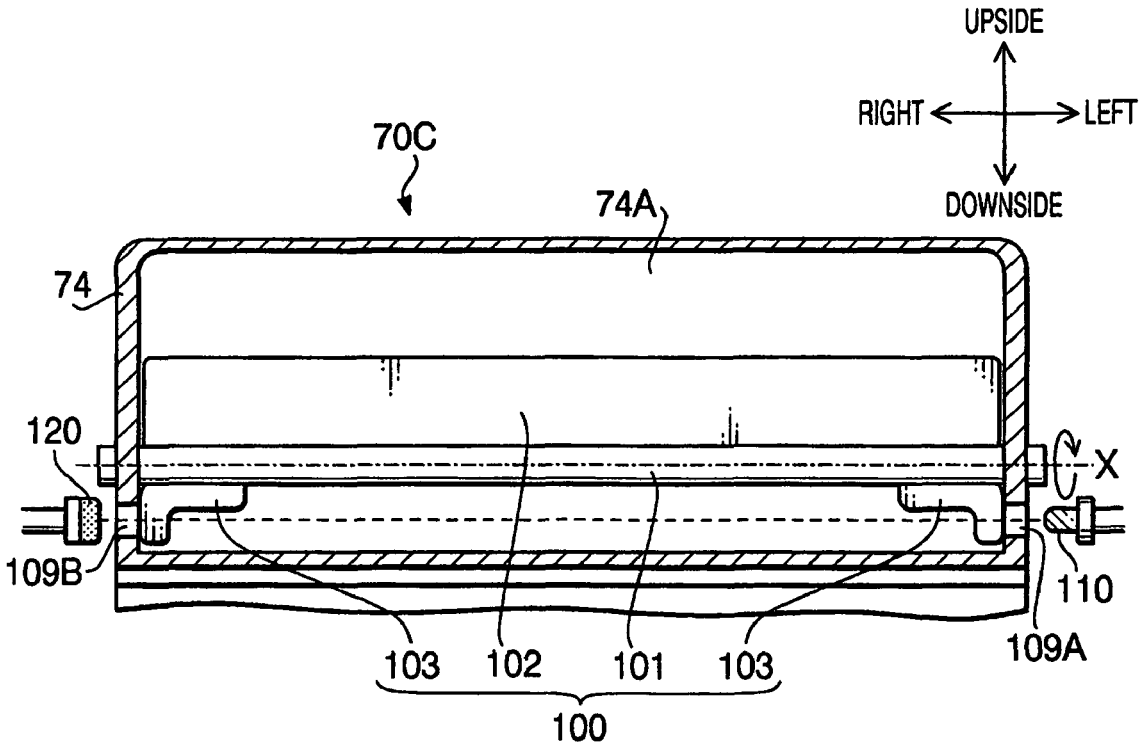
FIG. 3 is a cross-sectional view of the process cartridge along a III-III line shown in FIG. 2 in the embodiment according to one or more aspects of the present invention.

As shown in FIGS. 2 and 3, the agitating unit is provided to extend along a horizontal (right-to-left) direction in the container 74A of the process cartridge 70C. The agitating unit 100 includes a rotation shaft 101 driven by a driver (not shown) around a center axis X, an agitating plate 102 which is protruded from the rotation shaft 101 in a radial direction and elongated along the horizontal direction, and a pair of cleaning members 103 which are protruded from both right and left ends of the rotation shaft 101 in the opposite radial direction of the direction in which the agitating plate 102 is protruded. The agitating unit 100 is configured to agitate the toner in the container 74A with the agitating plate 102 rotated along with the rotation shaft 101.

It is noted that the toner used in the present embodiment is widely-known developer with a single positively-chargeable non-magnetic component which is formed in a spherical shape in a suspension polymerization method. Thus, detailed explanation of the toner will be omitted.

In addition, the agitating unit 100 is configured such that the cleaning members 103 rotated along with the rotation shaft 101 slide on and clean surfaces of transparent ports 109A and 109B respectively provided at left and right lower side faces of the container 74A.

6. Light Emitting Unit

The light emitting unit 110 includes a general light emitting diode. As shown in FIG. 3, the light emitting unit 110 is placed outside the transparent port 109 A at the lower left side face of the container 74A. Light emitted by the light emitting unit 110 is introduced into the container 74A through the transparent port 109A, transmitted through the container 74A, and emitted out of the container 74A through the transparent port 109B at the lower left side face of the container 74A.

7. Light Receiving Unit

The light receiving unit 120 includes a general phototransistor. As shown in FIG. 3, the light receiving unit 120 is placed outside the transparent port 109B at the lower right side face of the container 74A. The light receiving unit 120 is configured to receive the light emitted by the light emitting unit 110 through the transparent ports 109A and 109B and to output a voltage corresponding to an intensity of the light received thereby. The voltage is inputted into the control unit 40, and a light receiving efficiency (%) is calculated by the control unit 40. It is noted that, in the present embodiment, the light receiving efficiency (%) is determined as a ratio (generally, a duty ratio (%) is employed) of a total period during which the light intensity can be kept higher than a predetermined intensity (namely, a period during which the light emitted by the light emitting unit 110 is not blocked by the toner) in a predetermined sampling period, based on the light intensity of the light received by the light receiving unit 120. The light receiving efficiency (%) is utilized in the below-mentioned remaining toner estimating process.

Figure 4:
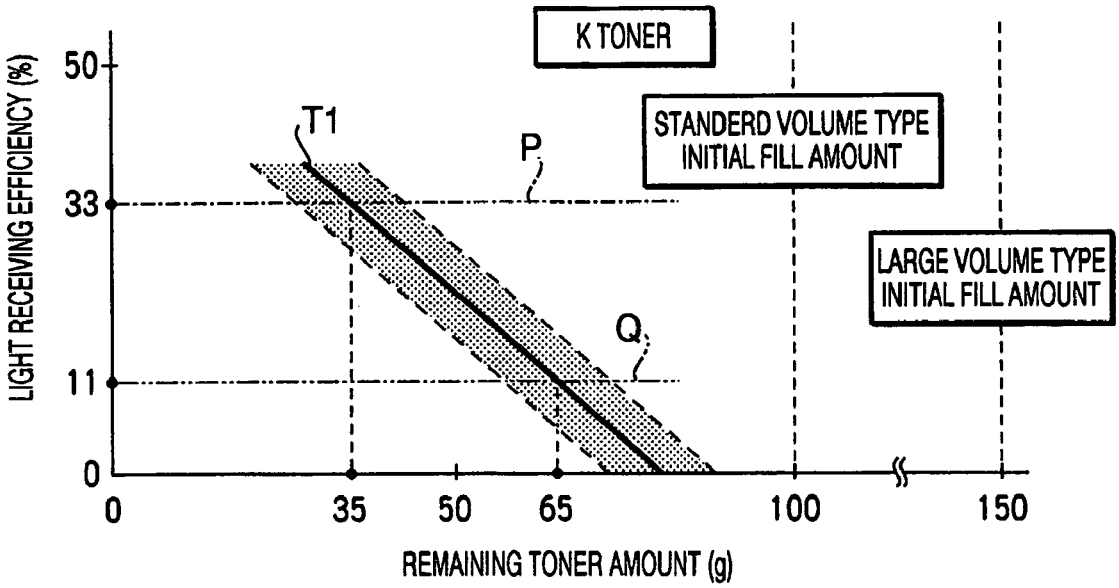
FIG. 4 shows relationship between a remaining toner amount in a container for K toner and a light receiving efficiency (%) in the embodiment according to one or more aspects of the present invention.

FIG. 4 shows relationship between a remaining toner amount in the container 74A of the K toner and the light receiving efficiency (%) by a heavy line T1. In addition, FIG. 5 shows relationship between a remaining toner amount in the container 74A of the CMY toner and the light receiving efficiency (%) by a heavy line T2. It is noted that these relationship charts are simplified for the sake of easy explanation. Hence, the relationship charts may vary when constituent elements such as the container, toner, light emitting unit, and light receiving unit vary.

In FIGS. 4 and 5, when there is a sufficient amount of toner left in the container 74A, the transparent ports 109A and 109B are completely blocked by the toner, and therefore the light receiving efficiency is 0%. Incidentally, the remaining toner amount (initial fill amount) in the container 74A of a new cartridge is 150 g for a large volume type, or 100 g for a standard volume type. The large volume type is different from the standard volume type only in the initial amount of the toner filling the container 74A, and a user selects either of the both types in consideration of usage frequency and running cost of the cartridge.

As the remaining toner amount in the container 74A is gradually consumed such that the light emitted by the light emitting unit 110 is transmitted through the transparent ports 109A and 109B and reaches the light receiving unit 120, the light receiving efficiency (%) gradually increases. Incidentally, the K toner has a higher capability of blocking and absorbing the light passing through the container 74A than the CMY toner. Therefore, as understood from FIGS. 4 and 5, the light receiving efficiency (%) of the K toner is more sensitive to the remaining toner amount than that of the CMY toner.

Here, there will be given explanation regarding the case where the remaining toner amount is estimated with three levels of "Empty (remaining toner amount ≦35 g)," "Near-Empty (35 g<remaining toner amount ≦65 g)," and "Full (remaining toner amount >65 g)." In a conventional technique, by comparing the light receiving efficiency (%) with threshold P (%) or Q(%), it is judged which level of "Empty," "Near-Empty," and "Full" the remaining toner amount belongs to.

Specifically, in the case of the K toner shown in FIG. 4, the threshold P (%) between "Empty" and "Near-Empty" is 33%, while the threshold Q (%) between "Near-Empty" and "Full" is 11%. Further, in the case of the CMY toner shown in FIG. 5, the threshold P (%) between "Empty" and "Near-Empty" is 48%, while the threshold Q (%) between "Near-Empty" and "Full" is 19%.

However, since the toner in the container 74A is actually agitated by the agitating unit 100, the distribution of the toner with a high fluidity varies, and the agitating plate 102 and cleaning member 103 of the agitating unit 100 periodically shuts out the transparent ports 109A and 109B. Therefore, the relationship between the remaining toner amount and light receiving efficiency (%) fluctuates around the heavy line T1 or T2 with a certain width (indicated by a shaded region). Hence, in the conventional technique, it is hard to improve the accuracy of estimating the remaining toner amount with the light receiving efficiency (%). Consequently, for example, it might lead improper judgment that there is a small amount of toner left in the container 74A even though the image forming operation is hardly performed after an old toner cartridge has been replaced with the present toner cartridge 74 and there is sufficient toner left in the container 74A.

In order to solve the above problem, the laser printer 1 of the present embodiment is configured to modify the light receiving efficiency (%) with a correction coefficient shown in FIG. 7 and compare the light receiving efficiency (%) modified with the threshold P (%) or Q (%) in the below-mentioned remaining toner estimating process. Hereinafter, the remaining toner estimating process will be described in detail.

8. Remaining Toner Checking Process

The remaining toner estimating process is performed for each of the containers 74A of the four sorts of toners with the different colors CMYK, as required, for example, at the time of start-up, stand-by, or image forming operation of the laser printer 1. It is noted that the same flowchart is employed in both the case where the remaining amount of the K toner in the container 74A is estimated and the case where the remaining amount of the CMY toner in the container 74A is estimated. However, details about it will be described later, yet values of the correction coefficient used in S110, values of the threshold P (%) used in S112, and values of the threshold Q (%) used in S113 are different between both the cases.

When the remaining toner estimating process is started (S100), it is judged whether the toner cartridge 74 is a new one (S101). When the toner cartridge 74 is new, it is judged with the aforementioned detector that the toner cartridge 74 is a new one (S101: Yes). Then, the present process goes to S102, in which the control unit 40 resets a dot count. Thereafter the present process goes to S103.

Here, the dot count denotes an accumulated number of printed dots constituting images formed in image forming operations executed since first use of a container. The dot count is used for calculating a conversion page number as an execution amount of the image forming operations (which corresponds to an amount of toner consumed in the image forming operations executed since the first use of the container) in S109 and for determining the correction coefficient in S110. In addition, to reset the dot count represents to set the correction coefficient to be an initial value.

Meanwhile, when it is not judged that the toner cartridge 74 is a new one (S102: No), the present process goes to S103, in which the light emitting unit 110 and light receiving unit 120 are set ON.

Subsequently, from S104 to S107, the light intensity of the light received by the light receiving unit 110 is sampled a predetermined number of times. The result of the light intensity by the light receiving unit 110 is transmitted to the control unit 40 every sampling.

Next, in S108, the light receiving efficiency (%) is calculated by the control unit 40 based on the light intensity of the light received by the light receiving unit 110.

Subsequently, in S109, the conversion page number as the execution amount of the image forming operations is calculated. Here, in the present embodiment, the conversion page number is determined with a following equation under assumption that 4% (which corresponds to 1,400,000 dots) of the area on a single A4-sized paper is generally occupied with printed dots.

$$\text{Conversion Page Number (sheets)} = \text{Dot Count}/1{,}400{,}000$$

It is noted that the conversion page number may be determined in any other ways.

Further, the execution amount of the image forming operations may be estimated with an accumulated number of rotations of the developing roller 74C, instead of calculating the conversion page number based on the dot count. Specifically, when 15 rotations of the developing roller 74C are required for the image forming operation on a single A4-sized paper, the conversion page number is determined with a following equation.

$$\text{Conversion Page Number (sheets)} = \text{Accumulated Number of Rotations of Developing Roller } 74C/15$$

Additionally, the execution amount of the image forming operations may be estimated with the number of actually printed papers, instead of the conversion page number.

Next, in S110, the correction coefficient is determined with a following expression.

$$\text{Correction Coefficient} = 1 - \exp(-(\text{conversion page number})/\alpha)$$

In the present embodiment, $\alpha=100$ in the case of the K toner, and $\alpha=200$ in the case of the CMY toner. Thus, a K toner correction coefficient and a CMY toner correction coefficient determined with the above expression smoothly vary to be closer to one as the conversion page number increases as shown in FIG. 7. It is noted that the correction coefficient may be determined in any other ways.

Subsequently, in S111, corrected light receiving efficiency (%) is determined with a following equation.

$$\text{Corrected Light Receiving Rate (\%)} = \text{Correction Coefficient} \times \text{Light Receiving Rate (\%)}$$

When the conversion page number is small, the corrected light receiving efficiency (%) determined as above is significantly modified to be somewhat smaller than the light receiving efficiency (%). Meanwhile, when the conversion page number is so large that the correction coefficient is close to one, the corrected light receiving efficiency (%) is substantially the same as the light receiving efficiency (%). In other words, the more the conversion page number is, the more the light receiving efficiency (%) is regarded to be reliable.

Next, in S112, it is judged whether the corrected light receiving efficiency (%) is larger than the threshold P (%). Here, the threshold P (%) is 33% in the case of the K toner, and 48% in the case of the CMY toner.

Then, when the judgment in S112 is affirmative (S112: Yes), the present process goes to S114, in which the remaining toner amount is estimated as "Empty." Thereafter, the present process is terminated in S120.

Meanwhile, when the judgment in S112 is negative (S112: No), the present process goes to S113, in which it is judged whether the corrected light receiving efficiency (%) is larger than the threshold Q (%). Here, the threshold Q (%) is 11% in the case of the K toner, and 19% in the case of the CMY toner.

When the judgment in S113 is negative (S113: No), the present process goes to S115, in which the remaining toner amount is estimated as "Full." Thereafter, the present process is terminated in S120.

Meanwhile, when the judgment in S113 is affirmative (S113: Yes), the present process goes to S116, in which the remaining toner amount is estimated as "Near-Empty." Thereafter, the present process is terminated in S120.

Thus, the laser printer 1 can accurately estimate the remaining toner amount in each of the containers 74A for the four sorts of toners with different colors CMYK with the three levels "Empty," "Near-Empty," and "Full."

A concrete example in the case of the K toner shown in FIG. 4 will be provided hereinafter.

(1) In the case where the light receiving efficiency (%) is estimated to be 15% when the dot count is 1,400,000×100, namely, the conversion page number is 100:

In this case, in the conventional technique, since the threshold Q (11%)≦the light receiving efficiency (15%)<the threshold P (33%), the remaining toner amount is estimated as "Near-Empty."

Meanwhile, in the present embodiment, the K toner correction coefficient is determined to be 0.63 from FIG. 7. Accordingly, the corrected light receiving efficiency (%) is determined as follows.

$$\text{Corrected Light Receiving Rate (\%)} = 0.63 \times 15 = 9.45\% < \text{Threshold } Q\ (11\%)$$

Therefore, the remaining toner amount is estimated as "Full."

(2) In the case where the light receiving efficiency (%) is estimated to be 15% when the dot count is 1,400,000×500, namely, the conversion page number is 500:

In this case, in the conventional technique, the remaining toner amount is estimated as "Near-Empty" in the same manner as the case (1).

Meanwhile, in the present embodiment, the K toner correction coefficient is determined to be 0.99 from FIG. 7. Accordingly, the corrected light receiving efficiency (%) is determined as follows.

$$\text{Corrected Light Receiving Rate (\%)} = 0.99 \times 15 = 14.9\% \geqq \text{Threshold } Q\ (11\%)$$

Therefore, the remaining toner amount is estimated as "Near-Empty."

Thus, the laser printer 1 of the present embodiment can appropriately modify the light receiving efficiency (%) with a smaller correction coefficient in the case of a smaller conversion page number, and thereby estimate the remaining toner amount in each of the containers 74A for the four sorts of toners with the different colors CMYK.

Hence, the laser printer 1 of the present embodiment can estimate the remaining toner amount in each of the containers 74A with higher accuracy. Consequently, it is possible to prevent improper judgment that there is a small amount of toner left in the container even though the image forming operation is hardly performed after an old toner cartridge has been replaced with the present toner cartridge 74.

Particularly, in FIGS. 4 and 5, when a new toner cartridge 74 of the standard volume type (initial fill amount: 100 g) is attached, there may be caused a case where the remaining toner amount, which is more than 70 g, is estimated as "Near-Empty" in the conventional technique. Hence, the user may misunderstand that the toner is enormously consumed though the toner cartridge 74 is a new one with which an old one has just been replaced. However, in the present embodiment, since the light receiving efficiency (%) is significantly modified with a small correction coefficient in the case of a small amount of image forming operations, the above problem can hardly be caused.

In addition, the laser printer 1 of the present embodiment determines the conversion page number as the execution amount of the image forming operations based on the dot count as a desired parameter which directly relates to toner consumption and appropriately represents the execution amount of the image forming operations. Therefore, the correction coefficient is properly determined depending on the conversion page number.

Furthermore, the laser printer I of the present embodiment is configured to selectively use the K toner correction coefficient for the K toner and CMY toner correction coefficient for the CMY toner when estimating the remaining toner amount in each of the containers 74A for the four sorts of toners with the different colors CMYK. Therefore, the laser printer 1 of the present embodiment can estimate the remaining toner amount with high accuracy even for each of the four sorts of toners which have different light receiving efficiencies between the K toner and the CMY toner.

In addition, the laser printer 1 of the present embodiment can automatically set the correction coefficient to be the initial value through the steps S101 and S102 in the remaining toner estimating process when the toner cartridge 74 is replaced with a new one. Therefore, the laser printer 1 of the present embodiment can certainly use an appropriate correction coefficient. Further, the user is not required to carry a burden to initialize the correction coefficient.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. An image forming device, comprising:

a container configured to accommodate toner;

a light emitting unit configured to emit light to be transmitted through the container;

a light receiving unit configured to receive the light transmitted through the container;

a computer; and one or more non-transitory computer readable media having executable instructions stored thereon that, when executed by the computer, cause the computer to function as:

an efficiency determining unit configured to determine a light receiving efficiency based on a light intensity of the light received by the light receiving unit;

an execution amount determining unit configured to determine an execution amount of image forming operations that represents an accumulated amount of image forming operations executed since first use of the container;

a correction coefficient determining unit configured to determine a correction coefficient based on the execution amount of image forming operations determined by the execution amount determining unit;

an efficiency modifying unit configured to modify the light receiving efficiency determined by the efficiency determining unit with the correction coefficient determined by the correction coefficient determining unit; and an estimating unit configured to estimate an amount of the toner remaining in the container based on the light receiving efficiency modified by the efficiency modifying unit.

2. The image forming device according to claim 1, further comprising a developing roller configured to hold the toner supplied from the container on a surface thereof, wherein the execution amount of image forming operations includes at least one of:

an accumulated number of papers on which the image forming operations have been executed since the first use of the container;

a dot count that represents an accumulated number of dots constituting images formed on the papers in the image forming operations since the first use of the container; and an accumulated number of rotations of the developing rollers in the image forming operations since the first use of the container.

3. The image forming device according to claim 1, wherein the correction coefficient includes a parameter varying so as to be closer to one as the execution amount of image forming operations increase, and wherein the efficiency modifying unit provides the modified light receiving efficiency by multiplying the light receiving efficiency by the parameter.

4. An image forming device, comprising:

a container configured to accommodate toner;

a light emitting unit configured to emit light to be transmitted through the container;

a light receiving unit configured to receive the light transmitted through the container;

a computer; and one or more non-transitory computer readable media having executable instructions stored thereon that, when executed by the computer, cause the computer to function as:

an efficiency determining unit configured to determine a light receiving efficiency based on a light intensity of the light received by the light receiving unit;

an execution amount determining unit configured to determine an execution amount of image forming operations that represents an accumulated amount of image forming operations executed since first use of the container;

a correction coefficient determining unit configured to determine a correction coefficient based on the execution amount of image forming operations determined by the execution amount determining unit;

an efficiency modifying unit configured to modify the light receiving efficiency determined by the efficiency determining unit with the correction coefficient determined by the correction coefficient determining unit; and an estimating unit configured to estimate an amount of the toner remaining in the container based on the light receiving efficiency modified by the efficiency modifying unit, wherein the correction coefficient includes a parameter varying so as to be closer to one as the execution amount of image forming operations increase, wherein the efficiency modifying unit provides the modified light receiving efficiency by multiplying the light receiving efficiency by the parameter, and wherein the parameter is determined with a following expression:

$$V=1-\exp(-A/\alpha),$$

where V represents a value of the parameter, A represents the execution amount of image forming operations, and $\alpha$ represents a predetermined constant value.

5. An image forming device, comprising:

a container configured to accommodate toner;

a light emitting unit configured to emit light to be transmitted through the container;

a light receiving unit configured to receive the light transmitted through the container;

a computer; and one or more non-transitory computer readable media having executable instructions stored thereon that, when executed by the computer, cause the computer to function as:

an efficiency determining unit configured to determine a light receiving efficiency based on a light intensity of the light received by the light receiving unit;

an execution amount determining unit configured to determine an execution amount of image forming operations that represents an accumulated amount of image forming operations executed since first use of the container;

a correction coefficient determining unit configured to determine a correction coefficient based on the execution amount of image forming operations determined by the execution amount determining unit;

an efficiency modifying unit configured to modify the light receiving efficiency determined by the efficiency determining unit with the correction coefficient determined by the correction coefficient determining unit; and an estimating unit configured to estimate an amount of the toner remaining in the container based on the light receiving efficiency modified by the efficiency modifying unit, wherein the container includes a plurality of containers that accommodate toners of different colors, respectively, wherein the light emitting unit and the light receiving unit are provided for each of the plurality of containers, wherein the efficiency determining unit determines the light receiving efficiency for each of the plurality of containers, wherein the correction coefficient includes at least two coefficients for modifying the light receiving efficiencies for the plurality of containers, and wherein the efficiency modifying unit modifies the light receiving efficiency for each of the plurality of containers with one of the at least two coefficients.

6. The image forming device according to claim 1, wherein the one or more non-transitory computer readable media having executable instructions stored thereon that, when executed by the computer, further cause the computer to function as:

a judging unit configured to judge whether the container is new; and an initializing unit configured to set the correction coefficient to be an initial value when the judging unit judges that the container is new.

7. The image forming device according to claim 1, wherein the light receiving efficiency is determined as a duty ratio of a period during which the light intensity of the light received by the light receiving unit is kept higher than a predetermined intensity in a predetermined sampling period.

8. A method applicable to an image forming device configured to estimate an amount of toner remaining in a container thereof with an efficiency of light transmitted through the container, the method comprising:

a first step of determining the efficiency based on a light intensity of the light transmitted through the container;

a second step of determining an execution amount of image forming operations that represents an accumulated amount of image forming operations executed since first use of the container;

a third step of determining a correction coefficient based on the execution amount of image forming operations determined in the second step;

a fourth step of modifying the efficiency determined in the first step with the correction coefficient determined in the third step; and a fifth step of estimating the amount of the toner remaining in the container based on the efficiency modified in the fourth step.

9. A non-transitory computer readable medium having computer readable instructions stored thereon, which cause a computer capable of image forming operations, configured to estimate an amount of toner remaining in a container thereof with an efficiency of light transmitted through the container, to perform:

a first step of determining the efficiency based on a light intensity of the light transmitted through the container;

a second step of determining an execution amount of image forming operations that represents an accumulated amount of image forming operations executed since first use of the container;

a third step of determining a correction coefficient based on the execution amount of image forming operations determined in the second step;

a fourth step of modifying the efficiency determined in the first step with the correction coefficient determined in the third step; and a fifth step of estimating the amount of the toner remaining in the container based on the efficiency modified in the fourth step.

* * * * *